US006271827B1

(12) United States Patent
Matsumoto

(10) Patent No.: US 6,271,827 B1
(45) Date of Patent: Aug. 7, 2001

(54) DISPLAY SYSTEM

(75) Inventor: Toshio Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/325,749

(22) Filed: Jun. 4, 1999

(30) Foreign Application Priority Data

Jun. 4, 1998 (JP) ..... 10-156504

(51) Int. Cl.[7] ..... G09G 5/04
(52) U.S. Cl. ..... 345/153; 345/132; 345/154; 345/155
(58) Field of Search ..... 345/150, 153, 345/154, 155, 1, 3, 5, 7, 22, 88, 132, 112, 428; 358/530, 539, 515; 346/46

(56) References Cited

U.S. PATENT DOCUMENTS

| | | | | |
|---|---|---|---|---|
| 4,868,643 | * | 9/1989 | Taguchi | 358/524 |
| 5,229,762 | * | 7/1993 | Itoh et al. | 345/153 |
| 5,450,216 | * | 9/1995 | Kasson | 358/518 |
| 5,872,556 | * | 2/1999 | Rackley et al. | 358/518 |
| 5,900,860 | * | 5/1999 | Ueda | 345/154 |
| 5,903,366 | * | 5/1999 | Hirabayashi et al. | 345/150 |
| 6,081,254 | * | 6/2000 | Tanaka et al. | 358/539 |
| 6,115,031 | * | 9/2000 | Love et al. | 345/154 |
| 6,166,720 | * | 12/2000 | Sim | 345/154 |

FOREIGN PATENT DOCUMENTS 61144190 7/1986 (JP) .

* cited by examiner

*Primary Examiner*—Matthew Luu
*Assistant Examiner*—Thu-Thao Havan

(57) ABSTRACT

A display system is provided, which includes: a display memory for storing display data of a first predetermined format; a display apparatus for displaying the display data read from the display memory; a memory control circuit for controlling reading of the display data stored in the display memory and writing of the display data to the display memory, based on a control signal input from a control device externally provided from the display system; an input/output format determination unit for determining whether a format of the display data to be input/output between the control device and the display system is the first predetermined format or a second predetermined format which is different from the first predetermined format; a first format converting circuit for converting the display data of the second predetermined format into the display data of the first predetermined format; a second format converting circuit for converting the display data of the first predetermined format into the display data of the second predetermined format; a first data selector for selecting one of the display data input from the control device and the display data which has been converted by the first converting circuit in accordance with the determination result by the input/output format determination unit and for outputting the selected display data to the display memory; and a second data selector for selecting one of the display data output from the display memory and the display data which has been converted by the second converting circuit in accordance with the determination result by the input/output format determination unit and for outputting the selected display data to the control device.

7 Claims, 6 Drawing Sheets

*FIG. 2A* At a time when display data is output
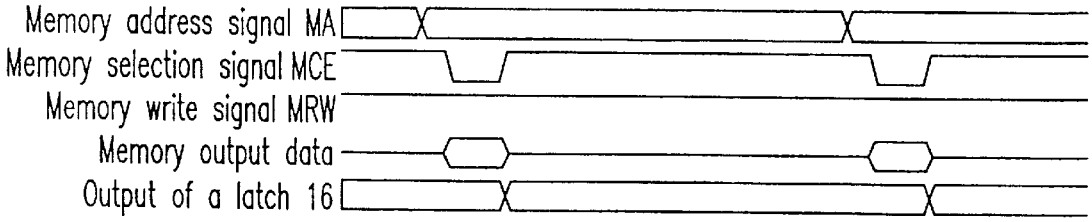
*FIG. 2B* At a time when an RGB signal is written
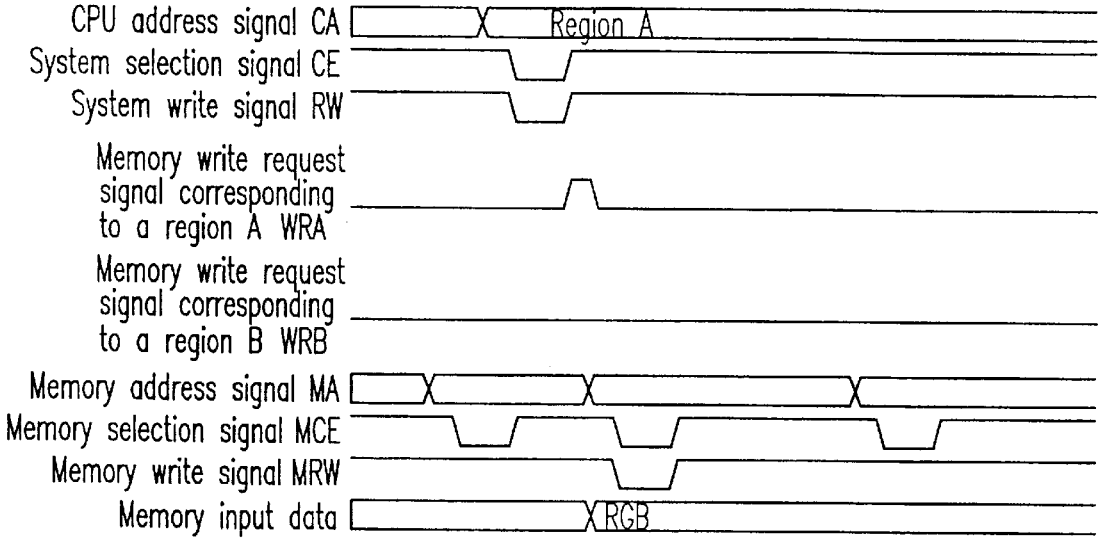
*FIG. 2C* At a time when a YUV signal is written
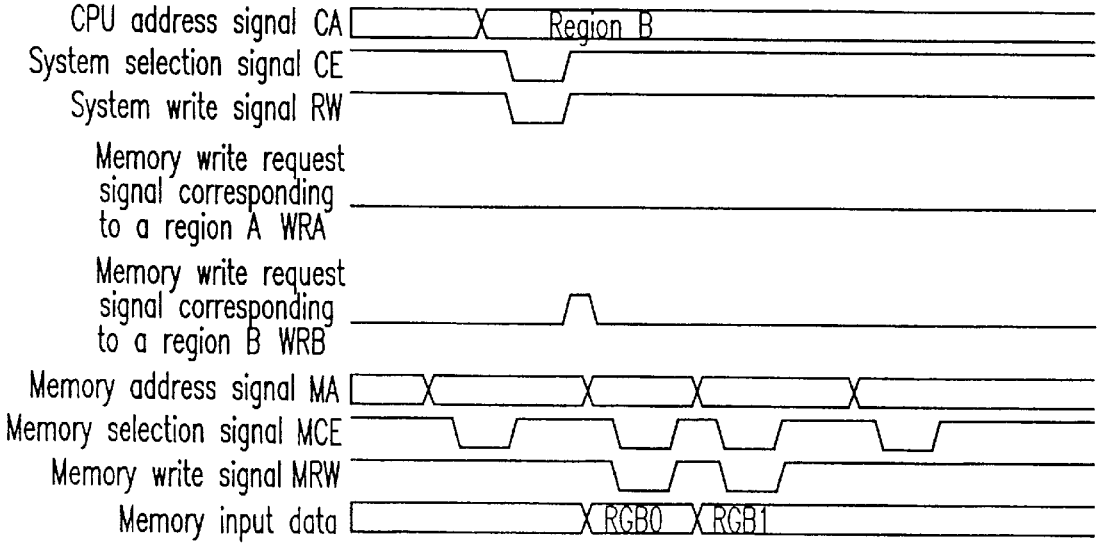

*FIG. 5A* RGB 8:8:8 format
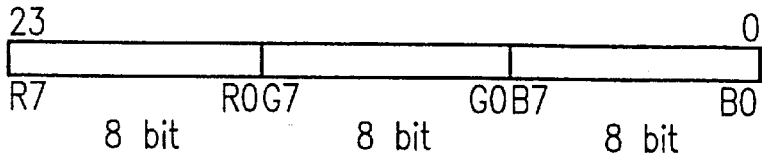
*FIG. 5B* RGB 5:6:5 format
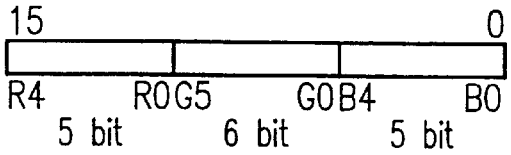
*FIG. 5C* YUV 4:4:4 format
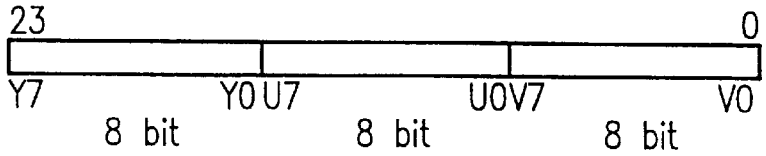
*FIG. 5D* YUV 4:2:2 format
YU data
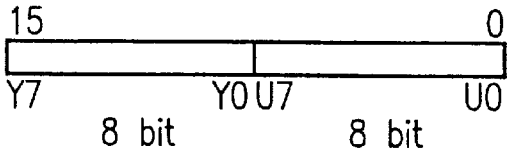
YV data
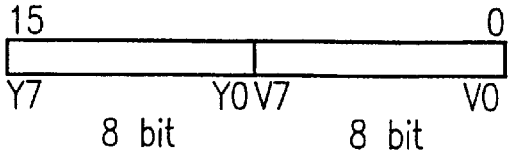

DISPLAY SYSTEM

BACKGROUND OF THE INVENTION

1. Field of the Invention

The present invention relates to a display system in an information processing apparatus such as a portable information terminal and a personal computer.

2. Description of the Related Art

In general, display data is displayed by a display apparatus such as a cathode ray tube (CRT) or a liquid crystal display (LCD) in a display system of an information processing apparatus such as a portable information terminal and a personal computer.

FIG. 4 shows a configuration of a conventional display system 400. The display system 400 includes a display apparatus 41, a display memory 42, and a memory control circuit 43. The memory control circuit 43 is connected to a CPU 44 via a system data bus 45, and is controlled by the CPU 44.

In the display system 400, display data is transferred from the CPU 44 to the display memory 42 non-periodically and is stored in the display memory 42, while display data is transferred from the display memory 42 to the display apparatus 41 periodically and successively.

When the display system 400 performs color display, a color image signal is transmitted between the display apparatus 41 and the memory control circuit 43. The color image signal has either one of two formats. One is an RGB format and the other is a YUV format. Herein, the color image signal of the RGB format (i.e., RGB data) consists of three kinds of signals representing three primary colors (red, green, and blue). The color image signal of the YUV format (i.e., YUV data) consists of a luminance signal Y and a color-difference signal UV. In general, the YUV data is finally converted into the RGB data in the display apparatus, and color display is realized using the RGB data. The RGB data has better consistency with data which is to be finally processed in the display apparatus, while the YUV data represents better compression characteristics than the RGB data. Each of the two formats is used appropriately in view of these features of the formats.

Hereinafter, examples of various RGB formats and YUV formats will be described with reference to FIGS. 5A to 5D.

FIG. 5A shows an RGB 8:8:8 format as one example of the RGB format. According to the RBG 8:8:8 format, 8 bits are assigned to each color of RGB, and each color is represented in 256-level gray scales, whereby about 16,000,000 colors are produced by 24 bits in total.

FIG. 5B shows an RGB 5:6:5 format as another example of the RGB format. According to the RGB 5:6:5 format, color data per dot is represented by 16 bits, in view of the consistency with data processed by the CPU. Each color of RGB is represented by 5 bits, 6 bits, and 5 bits, respectively.

FIG. 5C shows a YUV 4:4:4 format as one example of the YUV format. 8 bits are assigned to each of Y, U, and V. Color data per dot is represented by 24 bits in total.

FIG. 5D shows a YUV 4:2:2 format as another example of the YUV format. Color data per dot is represented by 16 bits, in view of the consistency with data processed by the CPU. According to the YUV 4:2:2 format, the YUV data includes YU data and YV data. The YU data and the YV data are alternately repeated per dot. The YU data has a Y signal of 8 bits and a U signal of 8 bits. The YV data has a Y signal of 8 bits and a V signal of 8 bits.

When display data of the RGB format is transferred between the display apparatus 41 and the memory control circuit 43, display data is also stored in the display memory 42 in the RGB format. Furthermore, display data is also written and read by the CPU 44 in the RGB format.

Similarly, when display data of the YUV format is transferred between the display apparatus 41 and the memory control circuit 43, display data is also stored in the display memory 42 in the YUV format. Furthermore, display data is also written and read by the CPU 44 in the YUV format.

Thus, in the case where the format of the display data which is transferred from the CPU 44 to the display memory 42 is determined as a fixed format (i.e., either one of the RGB format or the YUV format), the format of data used in the display system 400 should be the same as the fixed format. However, in the case where the format of the display data which is transferred from the CPU 44 to the display memory 42 may sometimes match with the RGB format and may sometimes match with the YUV format, special data processing is required for writing display data in a format which is not matched with the data format in the display system.

For example, it is assumed that a display system includes a display memory for storing display data of the RGB format and a display apparatus for displaying the display data of the RGB format. In this case, if display data of the YUV format is transferred from the CPU to the display system, the display system cannot display the display data of the YUV data appropriately. The display data of the YUV format is first required to be converted into the display data of the RGB format. Such a conversion is made, for example, by software processing. The converted display data of the RGB format is stored in the display memory. In this case, the display system has the same hardware configuration as that of a display system which simply uses the RGB format.

FIG. 6 shows a configuration of another conventional display system 600. The display system 600 includes a data converter 61 dedicated for converting display data of the YUV format into display data of the RGB format and vice versa in addition to the elements in the display system 400 shown in FIG. 4. In the display system 600, display data of the YUV format is once written in the data converter 61, and the display data of the YUV format is converted into the display data of the RGB format. Then, the display data of the RGB format, which has been converted and output by the data converter 61, is read, and the read display data is written in the display memory 42.

Still another conventional display system is disclosed in Japanese Laid-Open Publication No. 61-144190. In such a display system, display data (image data) is supplied through a transmission path such as a telephone line, not from a CPU, and the supplied display data is converted from a YUV format into an RGB format and given to a display memory (frame memory). In this display system, an ID signal for identifying a format of display data is added to the display data. Display data is identified to be either in the RGB format or in the YUV format by detecting the ID signal. In the case where display data is identified in a YUV format, the display data is converted from a YUV format into an RGB format and stored in a display memory.

For the above-mentioned conversion of display data from a YUV format into an RGB format, the following conversion equations represented by equation (1-1) to equation (1-3) are generally used.

$$R=Y+1.402V \tag{1-1}$$

$$G=Y-0.714V-0.344U \tag{1-2}$$

$$B=Y+1.772U \tag{1-3}$$

Depending upon the YUV-formatting procedure in a stage where display data of interest is created, a coefficient applied to the above-mentioned equations (1-1) to (1-3) may be varied. However, it is basically required to multiply an original signal value of YUV by a certain coefficient and obtain a sum (or difference) thereof.

The conventional display system 400 (FIG. 4) has the following problem. In the case where a display system using display data in both a YUV format and an RGB format has a hardware configuration for only the RGB format, while conversion from the YUV format into the RGB format is performed by software processing, the software processing for the sum of products operation in conversion from the YUV format into the RGB format involves a large number of programming steps. Therefore, it takes much time to perform such sum of products operation processing. This causes much more time to be spent for converting display data from a YUV format into an RGB format and writing the display data in a display memory, which decreases the display speed.

In the conventional display system 600 (FIG. 6), since the dedicated data converter is provided, the time required for conversion from the YUV format into the RGB format can be further shortened compared with the case of using software processing. However, according to the display system 600, display data in a YUV format is once written in the data converter, and the display data is converted from a YUV format into an RGB format. Then, the display data in an RGB format, which has been converted and output by the data converter, is read, and the read display data is written in a display memory. Therefore, compared with the case where display data in an RGB format is written as it is in a display memory, the number of writings and readings of display data from the CPU becomes larger, which decreases the display speed accordingly.

In the case where an ID signal is added to the display data as in the display system described in Japanese Laid-Open Publication No. 61-144190, the ID signal is always required in addition to the display data. When the display data is transferred from a CPU, both the display data and the ID signal are required to be transferred together. Therefore, the display speed is decreased by an increase in a data transfer amount.

SUMMARY OF THE INVENTION

A display system of the present invention includes: a display memory for storing display data of a first predetermined format; a display apparatus for displaying the display data read from the display memory; a memory control circuit for controlling reading of the display data stored in the display memory and writing of the display data to the display memory, based on a control signal input from a control device externally provided from the display system; an input/output format determination unit for determining whether a format of the display data to be input/output between the control device and the display system is the first predetermined format or a second predetermined format which is different from the first predetermined format; a first format converting circuit for converting the display data of the second predetermined format into the display data of the first predetermined format; a second format converting circuit for converting the display data of the first predetermined format into the display data of the second predetermined format; a first data selector for selecting one of the display data input from the control device and the display data which has been converted by the first converting circuit in accordance with the determination result by the input/output format determination unit and for outputting the selected display data to the display memory; and a second data selector for selecting one of the display data output from the display memory and the display data which has been converted by the second converting circuit in accordance with the determination result by the input/output format determination unit and for outputting the selected display data to the control device.

In one embodiment of the present invention, the control signal includes an address for storing the display data in the control device, the input/output format determination unit determines the format of the display data in accordance with the address.

In another embodiment of the present invention, the above-mentioned display system further includes a format setting unit for setting a format of the display data, and the input/output format determination unit determines the format of the display data in accordance with the format set by the format setting unit.

In another embodiment of the present invention, the display data of the second predetermined format includes a pair of a first data portion and a second data portion, and the display system further includes a first holding circuit for holding said first data portion and a second holding circuit for holding said second data portion, so that the pair of the first data portion and the second data portion be supplied to the first format converting circuit at the same time.

In another embodiment of the present invention, the control signal includes an address for storing the display data in the control device, the first data portion and the second data portion are identified by the address.

A display system of the present invention includes: a display memory for storing display data of a first predetermined format; a display apparatus for displaying the display data read from the display memory; a memory control circuit for controlling reading of the display data stored in the display memory and writing of the display data to the display memory, based on a control signal input from a control device externally provided from the display system; an input/output format determination unit for determining whether a format of the display data to be input/output between the control device and the display system is the first predetermined format or a second predetermined format which is different from the first predetermined format; a first format converting circuit for converting the display data of the second predetermined format into the display data of the first predetermined format; and a first data selector for selecting one of the display data input from the control device and the display data which has been converted by the first converting circuit in accordance with the determination result by the input/output format determination unit and for outputting the selected display data to the display memory.

A display system includes: a display memory for storing display data of a first predetermined format; a display apparatus for displaying the display data read from the display memory; a memory control circuit for controlling reading of the display data stored in the display memory and writing of the display data to the display memory, based on a control signal input from a control device externally provided from the display system; an input/output format determination unit for determining whether a format of the display data to be input/output between the control device and the display system is the first predetermined format or a second predetermined format which is different from the first predetermined format; a second format converting circuit for converting the display data of the first predetermined format into the display data of the second predetermined format; and a second data selector for selecting one of the display data output from the display memory and the display data which has been converted by the second converting circuit in accordance with the determination result by the input/output format determination unit and for outputting the selected display data to the control device.

Hereinafter, the function of the present invention will be described.

According to the above-mentioned structure, the input/output format determination unit determines that display data to be input/output is in an RGB format or a YUV format, based on a control signal to be input. In accordance with a predetermined format thus determined, the memory control circuit reads display data stored in the display memory and controls writing of display data to the display memory. At this time, in the case where data conversion is required, display data is converted from an RGB format into a YUV format or from a YUV format into an RGB format by the data converter. Thus, desired display data in an RGB format or a YUV format can be input/output between the CPU and the display memory. Furthermore, display data output from the display memory is input to the display apparatus, whereby color display is performed.

According to a structure in which the input/output format determination unit determines an input/output format of display data based on a CPU address in a control signal, display data in a desired format can be exactly written or read only by changing a CPU address for writing or reading display data. Furthermore, an identification signal for determining an input/output format is not required to be added to display data. Therefore, a signal other than display data is not excessively input/output, and the data transfer amount is decreased, which shortens the time required for input/output of display data and enhances the display speed.

Furthermore, according to a structure in which the input/output format determination unit has a format setting unit for setting an input/output format of display data, and the input/output format of display data is determined based on setting by the format setting unit, two sets of CPU address spaces are not required to be assigned, under which condition display data can be input/output in a similar manner to the above.

Furthermore, in the case where display data is input in a YUV format, when one of a pair of YU data and YV data included in YUV data is input, the one of a pair of YU data and YV data is temporarily stored in the YUV data temporary storing unit as first input data. When second input data which is paired with the first input data is input, the second input data is input to the data converter together with the first input data stored in the YUV data temporary storing unit. That is, a pair of YU data and YV data is input to the data converter. As a result, display data in a YUV format is converted into that in an RGB format and stored in the display memory.

According to a structure in which it is determined whether or not input display data is to be stored in the YUV data temporary storing unit, YU data and YV data can be identified with only a CPU address. Therefore, it is not required to predetermine whether data given by the CPU is YU or YV every time writing or reading is performed. YU data and YV data may be merely written or read continuously from the CPU. Thus, a pair of YU data and YV data can be more easily and exactly input to the data converter for data conversion. Furthermore, display data in a YUV format can be converted into that in an RGB format and stored in the display memory more exactly at a higher speed.

Thus, the invention described herein makes possible the advantage of providing a display system which enables display data to be input and output in both an RGB format and a YUV format, which is capable of performing color display, and which enables the input/output speed and the display speed of display data to be enhanced.

This and other advantages of the present invention will become apparent to those skilled in the art upon reading and understanding the following detailed description with reference to the accompanying figures.

BRIEF DESCRIPTION OF THE DRAWINGS

FIGS. 2A through 2C are timing charts illustrating an operation of the display system in Embodiment 1 according to the present invention.

FIGS. 5A through 5D are diagrams illustrating various exemplary data formats of display data.

DESCRIPTION OF THE PREFERRED EMBODIMENTS

Hereinafter, the present invention will be described by way of illustrative embodiments with reference to the drawings.

Embodiment 1

Figure 1:
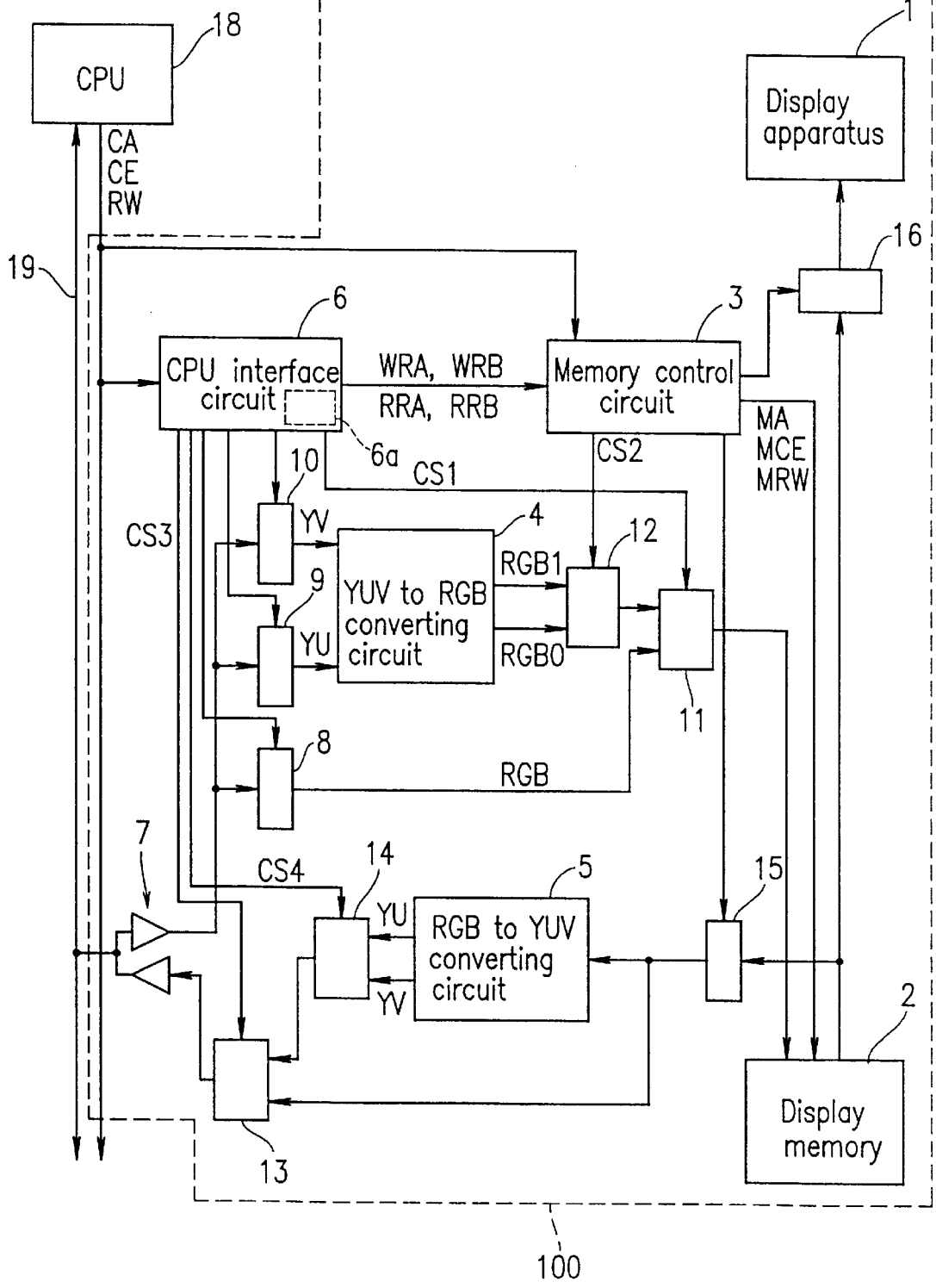
FIG. 1 is a block diagram showing an exemplary configuration of a display system in Embodiment 1 according to the present invention.

FIG. 1 shows an exemplary configuration of a display system 100 in Embodiment 1 according to the present invention. A display system 100 in Embodiment 1 includes a display apparatus 1, a display memory 2 for storing display data, a CPU interface circuit 6 for providing an interface between a CPU 18 and the display system 100, a memory control circuit 3 for controlling the reading of display data from the display memory 2 and the writing of display data to the display memory 2, based on an input control signal, an RGB to YUV converting circuit 5 for converting display data from an RGB format into a YUV format, a YUV to RGB converting circuit 4 for converting display data from a YUV format into an RGB format, and input/output determination unit 6*a* provided in the CPU interface circuit 6, for determining whether the format of data which is input/output between the CPU 18 and the display system 100 is an RGB format or a YUV format in accordance with the control signal. The display system 100 is connected to the CPU 18 via a system data bus 19. Display data in an RGB format or a YUV format is input/output between the CPU 18 and the display memory 2, in accordance with a predetermined format determined by the input/output format determination unit 6*a*, and the display data output from the display memory 2 is input in the display apparatus 1 for performing color display.

Next, operation of the display system 100 in Embodiment 1 will be described with reference to FIGS. 1 and 2.

In Embodiment 1, a display data input terminal of the display apparatus 1 is adapted for an RGB format, and data is also stored in the display memory 2 in an RGB format.

The display memory 2 is a memory with a data bus width of 16 bits per address, and stores display data per dot in the RGB 5:6:5 format per address. The display memory 2 is controlled by a memory selection signal MCE, a memory write signal MRW, and a memory address signal MA including a plurality of bits from the memory control circuit 3. The memory control circuit 3 enables the memory selection signal MCE (i.e., the memory selection signal MCE becomes "Low") for memory access. Whether the memory access is reading access or writing access is determined based on a signal level of the memory write signal MRW when the memory selection signal MCE is enabled. Herein, it is assumed that the memory write signal MRW is rendered "High" for reading, and the memory write signal MRW is rendered "Low" for writing.

First, when display is performed without rewriting display data, the memory control circuit 3 periodically reads display data from the display memory 2 as shown in FIG. 2A. The memory selection signal MCE is periodically enabled in accordance with an input cycle of display data in the display apparatus 1. During the enabled periods, the memory write signal MRW remains "High", indicating that the access is reading access, and reading access is performed with respect to the display memory 2. The memory address signal MA updates its value for each reading access, in accordance with each display position in the display apparatus 1. While the memory selection signal MCE remains "Low", display data in an RGB format corresponding to the memory address signal MA is output from the display memory 2. Therefore, a data latch 16 latches the display data in synchronization with the memory selection signal MCE. The latched RGB display data is kept as it is until the subsequent data latch, i.e., until the subsequent display memory is read. The RGB display data held by the data latch 16 is sent to the display apparatus 1, and displayed in the display apparatus 1. This processing is continuously performed irrespective of the processing of the CPU 18, after the display system is once set to be a display state.

Hereinafter, an operation of rewriting the display data stored in the display memory 2 in response to the request from the CPU 18 will be described. First, a system configuration will be described.

An operation of the display system 100 is controlled by a CPU address signal CA, a system selection signal CE, and a system write signal RW from the CPU 18. The functions of the system selection signal CE and the system write signal RW are the same as those of the memory selection signal MCE and the memory write signal MRW given to the display memory 2.

In the display system 100, an address space of the CPU 18 when display data is written in or read from the display memory 2 by the CPU 18 corresponds to an address space of the display memory 2. Herein, the case of a system configuration with a display screen size of 320×240 dots will be described. One display dot is represented by 16 bits as described above, and one dot is assigned to one address of a memory. In this example, an address size of 76800 dots (320×240) is required, which corresponds to an address space having a size of 12COOH (represented by hexadecimal notation). In this example, an address space (12COOH) of a display memory address MA (MA=OH to 12BFFH) is used for storage of display data.

The address space for the display memory 2 is assigned to a part of the address space for the CPU 18. In the address space for the CPU 18, one byte (i.e., 8 bits) is counted as one address, in view of the consistency with a device included in another system such as a ROM. In the address space for the display memory 2, 16 bits (i.e., one word) are counted as one address. Based on this, the size of the address space required for the display memory 2 is 12COOH. If this size of the address space is calculated on the address space for the CPU 18, twice the size of the address space (i.e., 25800H) is required to be assigned.

In the display system 100, the address space for the CPU 18 in writing display data into the display memory 2 and reading display data from the display memory 2 is assigned two regions. One region is assigned to an address space (0 to 257FFH) for the CPU 18, which will be referred to as region A. The other region is assigned to an address space (100000 to 1257FFH) for the CPU 18, which will be referred to as region B.

First, reading or writing of display data in an RGB format in relation to the region A will be described.

When the CPU 18 performs reading or writing access at CPU address 0H in the region A, memory access is performed at display memory address 0H in the display memory 2 in response to the reading or writing access. Similarly, when the CPU 18 performs reading or writing access at CPU address 2H in the region A, memory access is performed at display memory address 1H in the display memory 2 in response to the reading or writing access. When the CPU 18 performs reading or writing access at CPU address 257FEH in the region A in accordance with this relationship, memory access is performed at display memory address 12BFFH in the display memory 2 in response to the reading or writing access.

In reading or writing of the display data in relation to the region A, it is assumed that display data used by the CPU 18 is formatted in an RGB 5:6:5 format which is the same as that in the display memory 2. The address space for the CPU 18 is on a byte basis; therefore, there is a possibility that access is performed on a byte (8 bits) basis by the CPU 18. In this case, reading or writing may be performed with respect to only a half of 16-bit data (i.e., 8 bits) on a corresponding memory address. Thus, in order to perform access on a byte basis, the display memory 2 should have a function (byte enable function) of accessing on a byte basis (i.e., a half of 16-bit data (8 bits) per address).

Next, reading or writing of display data in a YUV format in relation to the region B will be described.

The relationship between the CPU address and the display memory address in the region B is similar to that in the region A. When the CPU 18 performs reading or writing access at CPU address 100000H in the region B, memory access is performed at display memory address 0H in the display memory 2 in response to the reading or writing access. When the CPU 18 performs reading or writing access at CPU address 1257FEH in the region B, memory access is performed at display memory address 12BFFH in the display memory 2 in response to the reading or writing access. It should be noted that access to 2 dots is performed as one set in the region B, and therefore, the processing becomes more complicated than that in the region A. This will be described later.

Unlike reading or writing of the display data in relation to the region A in reading or writing of the display data in relation to the region B, display data used by the CPU 18 is formatted in a YUV 4:2:2 format.

Hereinafter, the YUV 4:2:2 format will be described in detail. The YUV 4:2:2 format is represented by 16-bit data per display dot. The detail thereof is as follows. First, display dots in a horizontal direction are classified into two groups in such a manner that every other dot belongs to one group and the remaining dots belong to the other group. One group will be referred to as an even number group, and the other group will be referred to as an odd number group. It is defined that the first (0-th) dot belongs to the even number group, and the subsequent dot belongs to the odd number group. In the even number group, display data is composed of a Y signal (luminance signal) of 8 bits and a U signal (color-difference signal) of 8 bits. In the odd number group, display data is composed of a Y signal (luminance signal) of 8 bits and a V signal (color-difference signal) of 8 bits. Because of such a data configuration, a Y signal has independent data for each dot, while a U signal and a V signal have effective data only for every other dot. This is contrived based on the visual characteristics of humans. More specifically, the eyes of humans recognize brightness (luminance) information in detail; however, they have a low degree of recognition with respect to color information. Therefore, a U signal and a V signal, which are color-difference signals corresponding to color information, are designed so as to be transmitted with a decreased information amount compared with a Y signal which is a luminance signal.

In the display system, the following relationship is used between display data of the YUV 4:2:2 format accessed by the CPU 18 and display data of the RGB 5:6:5 format stored in the display memory 2. It is defined that the details of the display data of the YUV format used by the CPU 18 in the even number group are Y0 and U0, the details of the display data of the YUV format used by the CPU 18 in the odd number group are Y1 and V1, the details of the display data of the RGB format stored in the display memory 2 in the corresponding even number group are R0, G0, and B0, and the details of the display data of the RGB format stored in the display memory 2 in the corresponding odd number group are R1, G1, and B1. When described in accordance with the above address assignment, this corresponds to the case where Y0 and U0 are written at CPU address 100000, and Y1 and V1 are written at CPU address 100002; R0, G0, and B0 are correspondingly written at memory address 0, and R1, G1, and B1 are correspondingly written at memory address 1. In summary, YU data is transferred between the CPU 18 and the display system 100 when the CPU address is an integral multiple of 4, and YV data is transferred between the CPU 18 and the display system 100 when the CPU address is an integral multiple of 4 with 2 added thereto.

The relationship between the display data (Y0, U0), (Y1, V1), (R0, G0, B0), and (R1, G1, and B1) is represented by the following equations (2-1) to (2-3) and (3-1) to (3-3), based on the above-mentioned equations (1-1) to (1-3).

$$R0=Y0+1.402V1 \quad (2\text{-}1)$$

$$G0=Y0-0.714V1-0.344U0 \quad (2\text{-}2)$$

$$B0=Y0+1.772U0 \quad (2\text{-}3)$$

$$R1=Y1+1.402V1 \quad (3\text{-}1)$$

$$G1=Y1-0.714V1-0.344U0 \quad (3\text{-}2)$$

$$B1=Y1+1.772U0 \quad (3\text{-}3)$$

The YUV to RGB converting circuit 4 performs conversion from the YUV data to the RGB data in accordance with the equations (2-1) to (2-3) and (3-1) to (3-3).

An operation for rewriting the display data stored in the display memory 2 in response to the request from the CPU 18 will be described in detail, based on the above-mentioned system configuration.

First, the case where display data of the RGB format is transferred from the CPU 18 to the display system 100 will be described with reference to FIGS. 1 and 2B. In this case, the CPU 18 generates a request for writing display data in the display system 100 with a CPU address in the region A corresponding to a display memory address in which display data is desired to be written. The CPU interface circuit 6 decodes a given CPU address so as to identify that the current CPU access is an access to the region A. Based on this identification, display data of the RGB format given by the CPU 18 is latched by a data latch 8 via an input/output buffer 7. Simultaneously, a memory address is converted from the CPU address and the memory address is latched in the memory control circuit 3. In response to the request for writing display data from the CPU 18, the CPU interface circuit 6 sends a memory write request signal WRA corresponding to the region A to the memory control circuit 3, based on the CPU address being a multiple integral of 4. The CPU interface circuit 6 also sends a control signal CS1 to a data selector 11 so as to control the data selector 11 to select an output signal of the data latch 8.

The memory control circuit 3 receives the memory write request signal WRA corresponding to the region A given by the CPU interface circuit 6, and performs writing access to the display memory 2. In this case, display data is periodically read from the display apparatus 1, so that the memory control circuit 3 writes data, waiting for an interval between reading accesses of the display data. The memory address MA at a time of writing access is a memory address converted from the previously latched CPU address, and input data of the display memory 2 is data stored in the data latch 8 given through the data selector 11, i.e., RGB data supplied from the CPU 18. Thus, RGB data supplied from the CPU 18 is written at a desired display memory address.

Next, the case where display data of the YUV format is transferred from the CPU 18 to the display system 100 will be described with reference to FIGS. 1 and 2C.

In this case, YU data and YV data are given by the CPU 18. In order to write display data of the RGB format in the display memory 2, three data Y, U, and V for converting YUV data into RGB data are required. Therefore, in the display system 100, display data is not written in the display memory 2 until two requests are obtained: a writing request involving YU data from the CPU 18 and a writing request involving YV data from the CPU 18. This procedure is as follows.

The CPU 18 generates a request for writing display data in the display system 100 with a CPU address in the region B corresponding to a display memory address in which display data is desired to be written, the CPU address being an address of a multiple integral of 4 (0, 4, 8, . . . ). The CPU 18 outputs YU data (i.e., Y0 data and U0 data). The CPU interface circuit 6 decodes a given CPU address so as to identify that the current CPU access is an access to the region B. Based on this identification, the YU data given by the CPU 18 is latched by a data latch 9 via the input/output buffer 7. The memory write request signal WRB has not been sent to the memory control circuit 3.

Next, the CPU 18 generates a request for writing display data in the display system 100 with a CPU address in the region B. In this case, the CPU address in the region B corresponds to a memory address adjacent to the display memory address used when a previous writing request involving YU data is generated. The CPU address is an address of a multiple integral of 4 with 2 added thereto. The CPU 18 outputs YV data (i.e., Y1 data and V1 data). The CPU interface circuit 6 decodes a given CPU address so as to identify that the current CPU address is an address of a multiple integral of 4 with 2 added thereto in the region B. Based on this identification, YV data given by the CPU 18 is latched by a data latch 10 via the input/output buffer 7. A memory address converted from the CPU address is latched by the memory control circuit 3. In response to the request for writing display data from the CPU 18, the CPU interface circuit 6 sends a memory write request signal WRB corresponding to the region B to the memory control circuit 3, based on the CPU address being an address of a multiple integral of 4 with 2 added thereto in the region B. The CPU interface circuit 6 also sends the control signal CS1 to the data selector 11 so as to control the data selector 11 to select an output signal of the YUV to RGB converting circuit 4.

The YUV to RGB converting circuit 4 receives a Y0 signal and a U0 signal from the data latch 9. The YUV to RGB converting circuit 4 also receives a Y1 signal and a V1 signal from the data latch 10. Upon receipt of these signals, the YUV to RGB converting circuit 4 performs conversion from YUV data into RGB data in accordance with the above-mentioned equations (2-1) to (2-3) and (3-1) to (3-3). As a result, RGB0 (R0, G0, B0) and RGB1 (R1, G1, B1) are output as RGB data corresponding to 2 dots.

The memory control circuit 3 receives the memory write request signal WRB corresponding to the region B given by the CPU interface circuit 6. The memory control circuit 3 waits for an interval between reading accesses of display data, and performs writing access to the display memory 2. At this time, display data is written with respect to two display dots. Therefore, writing is performed in the display memory 2 twice with varied address and data.

In the memory address MA at a time of the first writing access, it is assumed that each bit other than the least significant (LSB bit) is a memory address calculated from the previously latched CPU address, and the LSB bit is at a "Low" level. The memory control circuit 3 sends a control signal CS2 to a data selector 12, in synchronization with the first memory writing, thereby controlling the data selector 12 so that RGB0 data is selected among output data of the YUV to RGB converting circuit 4. In accordance with the results of the selections by the data selectors 11 and 12, RGB0 data obtained through conversion from YUV data to RGB data is input to the display memory 2, and RGB0 data is written at a desired display memory address in the even number group.

In the memory address MA at the time of the second writing access, it is assumed that each bit other than the LSB bit is a memory address calculated from the previously latched CPU address, and the LSB bit is at a "High" level. The memory control circuit 3 sends the control signal CS2 to the data selector 12, in synchronization with the second memory writing, thereby controlling the data selector 12 so that RGB1 data is selected among output data of the YUV to RGB converting circuit 4. In accordance with the results of the selections by the data selectors 11 and 12, RGB1 data obtained through conversion from YUV data to RGB data is input to the display memory 2, and RGB1 data is written at a desired display memory address in the odd number group.

As described above, in the display system 100, display data can be written by the CPU 18 in the display memory 2 in any of an RGB format and a YUV format. Furthermore, by changing only a CPU address for writing, display data can be correctly written in accordance with a desired format.

Furthermore, in the case where the CPU 18 writes display data of the YUV format in the display system 100, all the CPU 18 has to do is to write YU data and YV data in the display system 100. The YU data and YV data are automatically converted into the display data of the RGB format and converted display data is stored in the display memory 2. Thus, special software processing or the like is not required, and display data can be written at a high speed. Furthermore, YU data and YV data can be identified by only a CPU address. Therefore, it is not required to previously set whether data given by the CPU 18 is YU or YV every time writing is performed. YU data and YV data can be written continuously from the CPU 18, so that display data can be written at a higher speed.

In this example, when YU data is given, it is temporarily stored. Then, when YV data is given, it is input to the YUV to RGB converting circuit 4 together with the previous YU data so as to be converted, and the converted data is written in the display memory 2. However, it is also possible that YV data is temporarily stored.

The case where the CPU 18 writes display data of either a YUV format or an RGB format in the display memory 2 has been described. Hereinafter, the case where the CPU 18 reads the display data stored in the display memory 2 will be described with reference to FIG. 1.

In this case, display data is stored in an RGB format in the display memory 2. In the case where a request for reading of display data from the CPU 18 is directed to an RGB format, the display data stored in the display memory 2 is read as it is and sent to the CPU 18. On the other hand, in the case where a request for reading of display data from the CPU 18 is directed to a YUV format, the display data stored in the display memory 2 is converted from an RGB format into a YUV format by the RGB to YUV converting circuit 5, and YU data or YV data obtained by conversion is sent to the CPU 18. The relationship between an input signal RGB and an output signal YUV in the RGB to YUV converting circuit 5 is inverse to that in the YUV to RGB converting circuit 4, which can be represented by the following equations (4-1) to (4-3).

$$Y=0.3008R+0.5859G+0.1132B \tag{4-1}$$

$$U=-0.1680R-0.3320G+0.5000B \tag{4-2}$$

$$V=0.5000R-0.4180G-0.0820B \tag{4-3}$$

To the control for selecting one of RGB data stored in the display memory 2, and YU data or YV data output from the RGB to YUV converting circuit 5 and for sending the selected data to the CPU 18, the above-mentioned control used in writing display data is adaptively applied.

First, the case where the CPU 18 reads display data of RGB format in relation to the region A will be described in detail. In this case, the CPU 18 generates a request for reading display data from the display system 100 with a CPU address in the region A corresponding to a display memory address in which display data is desired to be read. The CPU interface circuit 6 decodes a given CPU address so as to identify that the current CPU access is an access to the region A. Based on this identification, a memory address calculated from the CPU address is latched by the memory control circuit 3. At this time, in response to the request for reading data from the CPU 18, the CPU interface circuit 6 sends a memory read request signal RRA corresponding to the region A to the memory control circuit 3 and sends a control signal CS3 to a data selector 13, based on the CPU address being in the region A. Thus, the data selector 13 is controlled so as to select RGB data read from the display memory 2.

The memory control circuit 3 receives the memory read request signal RRA corresponding to the region A given by the CPU interface circuit 6. The memory control circuit 3 waits for an interval between reading accesses of display data with respect to the display apparatus 1, and performs reading access to the display memory 2. The memory address MA at a time of reading access is a memory address calculated from the previously latched CPU address. RGB data read by reading access is latched by the data latch 15. An output from the data latch 15 is input to the RGB to YUV converting circuit 5, and input to the data selector 13 as it is. As described above, RGB data is selected by the data selector 13 when display data is read from the display memory 2. Therefore, the RGB data is sent to the CPU 18 as it is via the input/output buffer 7.

Next, the case where the CPU 18 reads display data of a YUV format in relation the region B will be described. In this case, display data stored in the display memory 2 is converted from an RGB format into a YUV format, and YUV data is returned to the CPU 18. This conversion allows both YU data and YV data to be generated with only RGB data corresponding to one dot. Therefore, unlike writing, display memory should be read once. In the case where the CPU 18 reads display data of a YUV format in relation to the region B, the CPU 18 generates a request for reading display data from the display system 100, with a CPU address in the region B corresponding to a display memory address in which display data is desired to be read. The CPU interface circuit 6 decodes a given CPU address so as to identify that the current CPU access is an access to the region B. Based on this identification, a memory address calculated from the CPU address is latched by the memory control circuit 3. In response to the request for reading display data from the CPU 18, the CPU interface circuit 6 sends a memory read request signal RRB corresponding to the region B to the memory control circuit 3 and sends the control signal CS3 to the data selector 13, based on the CPU address being in the region B. Thus, the data selector 13 is controlled so as to select output data of the RGB to YUV converting circuit 5.

In the case where the given CPU address is decoded and found to be an address of a multiple integral of 4 in the region B in the CPU interface circuit 6, the CPU interface circuit 6 sends a control signal CS4 to a data selector 14. Thus, the data selector 14 is controlled so as to select YU data among output signals from the RGB to YUV converting circuit 5. In the case where the current CPU address is an address of a multiple integral of 4 with 2 added thereto in the region B, the CPU interface circuit 6 sends the control signal CS4 to the data selector 14. Thus, the data selector 14 is controlled so as to select YV data among output signals from the RGB to YUV converting circuit 5.

The memory control circuit 3 receives the memory read request signal RRB corresponding to the region B given by the CPU interface circuit 6. The memory control circuit 3 waits for an interval between reading accesses of display data with respect to the display apparatus 1, and performs reading access to the display memory 2. The memory address MA at the time of reading access is a memory address calculated from the previously latched CPU address. RGB data read by reading access is latched by the data latch 15. An output from the data latch 15 is input to the RGB to YUV converting circuit 5, and input to the data selector 13 as it is. In the case where output data from the RGB to YUV converting circuit 5 is selected by the data selector 13, and the CPU address given to the data selector 14 is an address of a multiple integral of 4, YU data is selected among the output signals from the RGB to YUV converting circuit 5. In the case where the given CPU address is an address of a multiple integral of 4 with 2 added thereto, YV data is selected among the output signals from the RGB to YUV converting circuit 5. Therefore, the selected YU data or YV data is sent to the CPU 18 via the input/output buffer 7.

In the process of conversion from RGB data to YUV data described above, a YUV signal can be generated from the RGB signal corresponding to one dot. Alternatively, a U signal and a V signal among the YUV signal can be obtained by averaging RGB signals corresponding to two dots and converting the averaged RGB signals into a U signal and a V signal. In this case, in the memory control circuit 3, reading access is performed for two adjacent dots based on the memory read request signal RRB corresponding to the region B given by the CPU interface circuit 6, and RGB data is latched. RGB data corresponding to two dots thus latched are averaged and input to the RGB to YUV converting circuit 5. In FIG. 1, two dots of data latch and an average value generating circuit of an RGB signal are omitted.

Embodiment 2

Next, the present invention will be described by way of Embodiment 2 with reference to the block diagram of FIG. 3.

Figure 3:
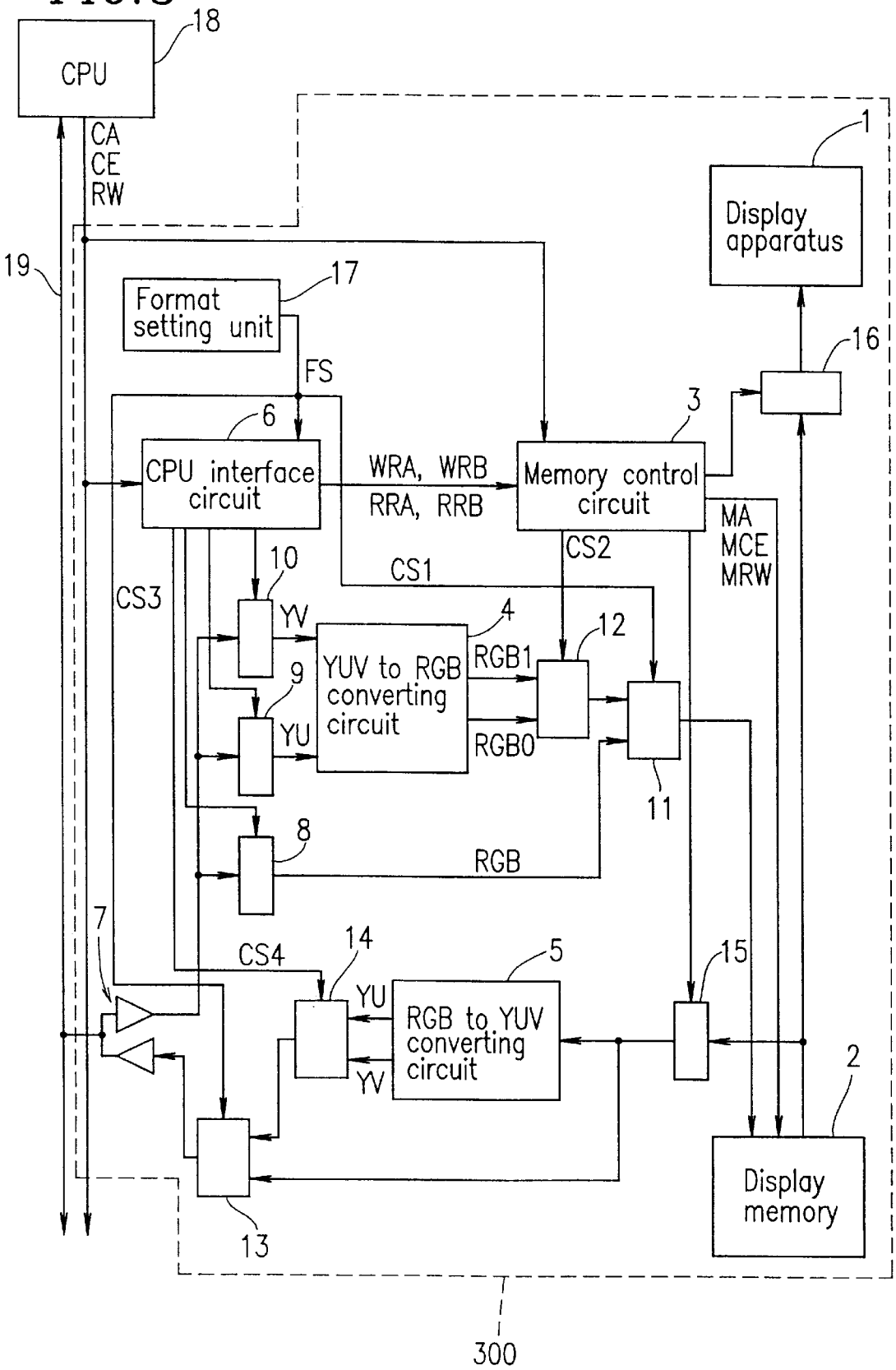
FIG. 3 is a block diagram showing an exemplary configuration of a display system in Embodiment 2 according to the present invention.
Figure 4:
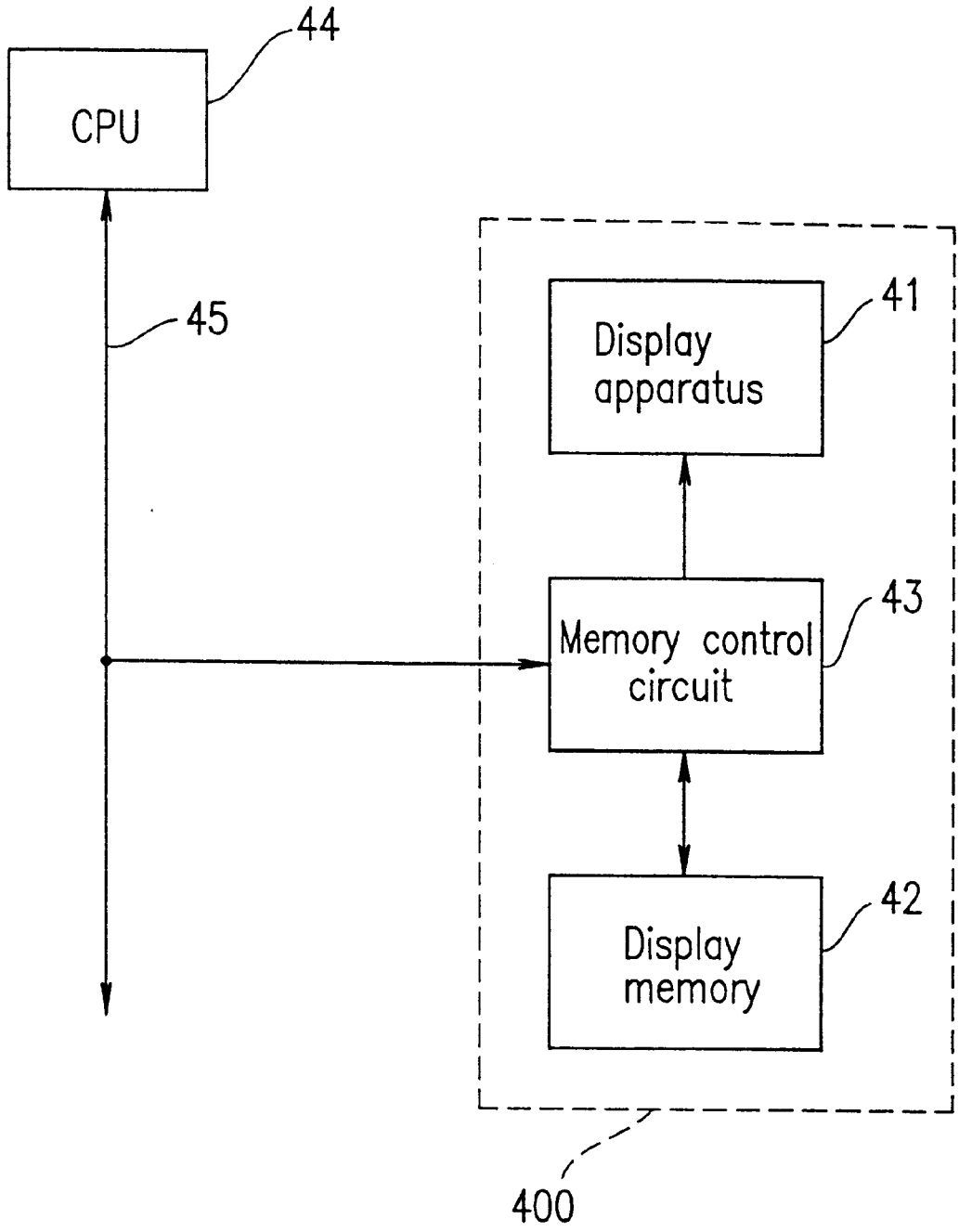
FIG. 4 is a block diagram showing a configuration of a conventional display system.
Figure 6:
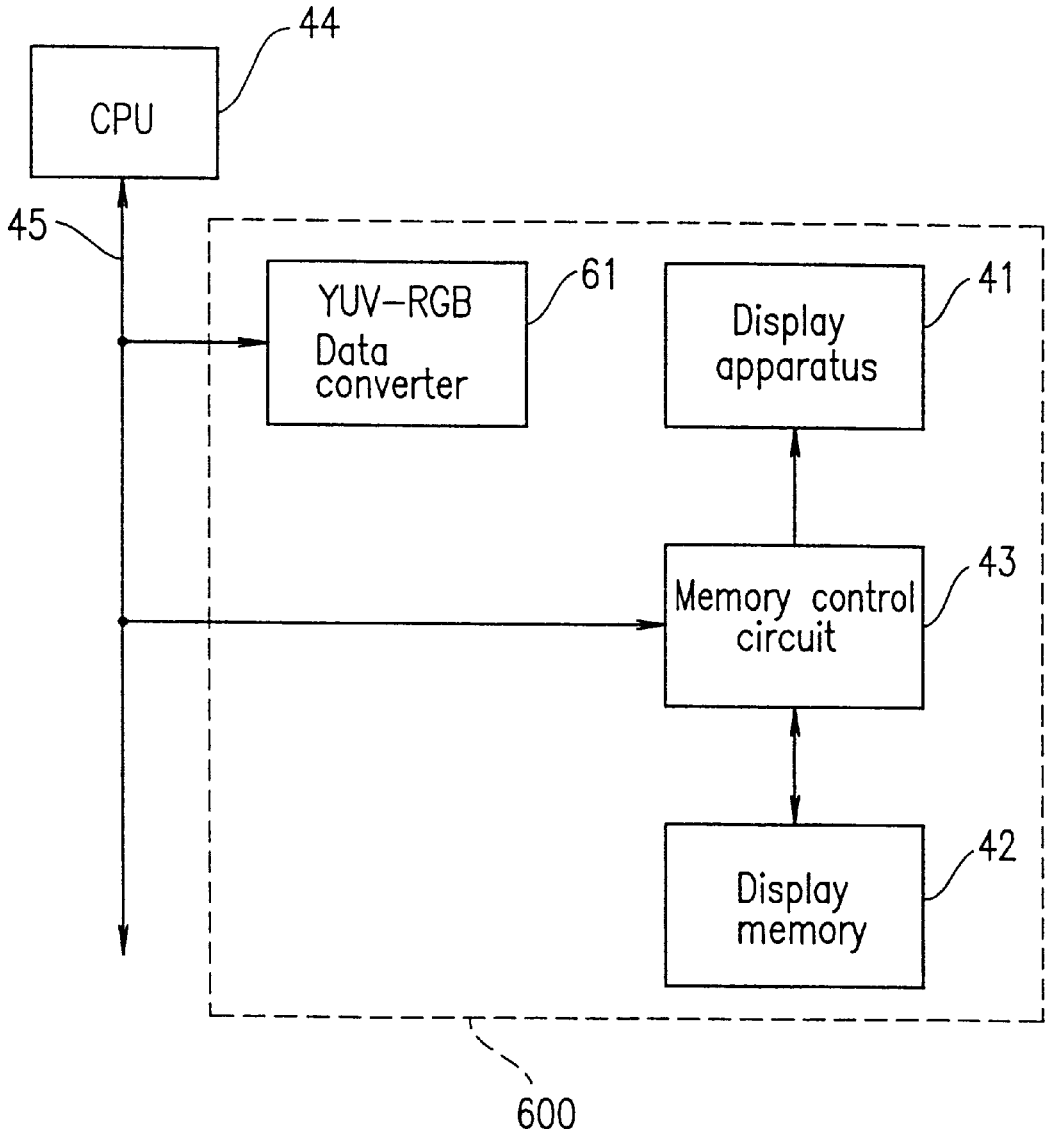
FIG. 6 is a block diagram showing a configuration in which a data converter is externally provided in a conventional display system.

FIG. 3 shows an exemplary configuration of a display system 300 in Embodiment 2 according to the present invention. The display system 300 includes a format setting unit 17 for setting an input/output format of display data, in addition to the elements of the display system 100 (FIG. 1). The format setting unit 17 is electrically connected to the CPU interface circuit 6, and the data selectors 11 and 13. Thus, the format setting unit 17 previously sets a format (RGB format or YUV format) of display data to be input/output. The format setting unit 17 outputs an output signal FS indicating a format set by the format setting unit 17 to the CPU interface circuit 6, and the data selectors 11 and 13.

Therefore, unlike Embodiment 1, selection of a format (RGB format or YUV format) of display data to be input/output can be controlled, based on the output signal FS without depending upon a CPU address.

Thus, in Embodiment 2, only one set of address space is required in the CPU 18, which is particularly useful in the case where two sets of address space for a display memory cannot be obtained in the CPU 18. The other control method in Embodiment 2 may be the same as that in Embodiment 1.

In Embodiments 1 and 2, although both the display apparatus and the display memory use the RGB format, the present invention is not limited thereto. Both of or either of the display apparatus and the display memory may use the YUV format. In addition, the present invention may use an arbitrary format other than the RGB format and the YUV format.

Furthermore, in the case where an address space of the CPU is allocated for the RGB format and the YUV format as in Embodiment 1, an address space of the display memory is also allocated for the RGB format and the YUV format so that the address space of the CPU corresponds to that of the display memory. In this case, in input/output of display data between the CPU and the display memory, data conversion by a data converter is not required, resulting in a decrease in the time required for input/output of display data. Furthermore, in the case of providing a format setting unit as in Embodiment 2, an operation similar to the above can be performed by allocating an address space of the display memory for the RGB form and the YUV form.

According to the display system of the present invention, the input/output format determination unit determines whether the format of display data to be input/output between the CPU and the display system is a first predetermined format (e.g., RGB format) or a second predetermined format (e.g., YUV format), based on a control signal to be input. Therefore, in accordance with the format determined by the input/output format determination unit, the memory control circuit automatically controls reading of the display data stored in the display memory and writing of the display data to the display memory. In the case where data conversion is required, display data is converted into a desired format by using the YUV to RGB converting circuit as a first format converting circuit and the RGB to YUV converting circuit as a second format converting circuit. Thus, desired display data in an RGB format or a YUV format can be exactly and rapidly input/output between the CPU and the display memory. Furthermore, display data output from the display memory is input to the display apparatus at a high speed, whereby color display is performed.

Furthermore, when the input/output format determination unit is configured to determine the input/output format of display data based on an address for storing display data in the control device externally provided from the display system (e.g., CPU address) included in a control signal, display data in a desired format can be exactly written or read only by changing the CPU address for writing or reading display data. Furthermore, an identification signal for determining an input/output format is not required to be added to display data. Therefore, a signal other than display data is not excessively input/output, and a data transfer amount is decreased, which shortens the time required for input/output of display data and enhances the display speed.

When the input/output format determination unit is configured to determine the input/output format of display data based on a format set by the format setting unit, two sets of CPU address spaces are not required to be assigned, under which condition display data can be input/output in a manner similar to the above. In this case, only one set of address space is required in the CPU, which is particularly useful in the case where two sets of space for a display memory cannot be obtained in the address space setting in the CPU.

Furthermore, by providing a first holding circuit (e.g., latch 9) for holding a first data portion (e.g., YU data) and a second holding circuit (e.g., latch 10) for holding a second data portion (e.g., YV data) in the display system, the timing of inputting a pair of YU data and YV data to the YUV to RGB converting circuit can be easily controlled. Furthermore, special software processing or the like is not required, so that display data can be exactly and rapidly converted from a YUV format into an RGB format and stored in the display memory.

In particular, YU data and YV data can be identified with only a CPU address. Therefore, it is not required to have previously set whether data given by the CPU is YU data or YV data every time writing or reading is performed. YU data and YV data may be written or read continuously from the CPU. Thus, a pair of YU data and YV data can be more easily and exactly input to the data converter for data conversion. Furthermore, display data in a YUV format can be converted into an RGB format and stored in the display memory more exactly at a higher speed.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A display system comprising:

a display memory for storing display data of a first predetermined format;

a display apparatus for displaying the display data read from the display memory;

a memory control circuit for controlling reading of the display data stored in the display memory and writing of the display data to the display memory, based on a control signal input from a control device externally provided from the display system;

an input/output format determination unit for determining whether a format of the display data to be input/output between the control device and the display system is the first predetermined format or a second predetermined format which is different from the first predetermined format;

a first format converting circuit for converting the display data of the second predetermined format into the display data of the first predetermined format;

a second format converting circuit for converting the display data of the first predetermined format into the display data of the second predetermined format;

a first data selector for selecting one of the display data input from the control device and the display data which has been converted by the first converting circuit in accordance with the determination result by the input/output format determination unit and for outputting the selected display data to the display memory; and a second data selector for selecting one of the display data output from the display memory and the display data which has been converted by the second converting circuit in accordance with the determination result by the input/output format determination unit and for outputting the selected display data to the control device.

2. A display system according to claim 1, wherein the control signal includes an address for storing the display data in the control device, the input/output format determination unit determines the format of the display data in accordance with the address.

3. A display system according to claim 1, further comprising a format setting unit for setting a format of the display data, and wherein the input/output format determination unit determines the format of the display data in accordance with the format set by the format setting unit.

4. A display system according to claim 1, wherein the display data of the second predetermined format includes a pair of a first data portion and a second data portion, and the display system further comprises a first holding circuit for holding said first data portion and a second holding circuit for holding said second data portion, so that the pair of the first data portion and the second data portion be supplied to the first format converting circuit at the same time.

5. A display system according to claim 4, wherein the control signal includes an address for storing the display data in the control device, the first data portion and the second data portion are identified by the address.

6. A display system comprising:

a display memory for storing display data of a first predetermined format;

a display apparatus for displaying the display data read from the display memory;

a memory control circuit for controlling reading of the display data stored in the display memory and writing of the display data to the display memory, based on a control signal input from a control device externally provided from the display system;

an input/output format determination unit for determining whether a format of the display data to be input/output between the control device and the display system is the first predetermined format or a second predetermined format which is different from the first predetermined format;

a first format converting circuit for converting the display data of the second predetermined format into the display data of the first predetermined format; and a first data selector for selecting one of the display data input from the control device and the display data which has been converted by the first converting circuit in accordance with the determination result by the input/output format determination unit and for outputting the selected display data to the display memory.

7. A display system comprising:

a display memory for storing display data of a first predetermined format;

a display apparatus for displaying the display data read from the display memory;

a memory control circuit for controlling reading of the display data stored in the display memory and writing of the display data to the display memory, based on a control signal input from a control device externally provided from the display system;

an input/output format determination unit for determining whether a format of the display data to be input/output between the control device and the display system is the first predetermined format or a second predetermined format which is different from the first predetermined format;

a second format converting circuit for converting the display data of the first predetermined format into the display data of the second predetermined format; and a second data selector for selecting one of the display data output from the display memory and the display data which has been converted by the second converting circuit in accordance with the determination result by the input/output format determination unit and for outputting the selected display data to the control device.

* * * * *